United States Patent [19]

Ingalsbe

[11] Patent Number: 4,925,393

[45] Date of Patent: May 15, 1990

[54] 66 BLOCK ADAPTER

[75] Inventor: David L. Ingalsbe, Hastings, Minn.

[73] Assignee: Independent Technologies, Inc., Omaha, Nebr.

[21] Appl. No.: 240,967

[22] Filed: Sep. 6, 1988

[51] Int. Cl.[5] ..... H01R 9/09

[52] U.S. Cl. ..... 439/76; 439/638

[58] Field of Search ..... 439/76, 78, 300, 344, 439/638, 653, 668, 669, 676

[56] References Cited

U.S. PATENT DOCUMENTS

| | | | |
|---|---|---|---|
| 4,362,905 | 12/1982 | Ismail | 179/1 PC |
| 4,392,701 | 7/1983 | Weidler | 439/638 |
| 4,470,102 | 9/1984 | DeLuca et al. | 361/428 |
| 4,602,842 | 7/1986 | Free et al. | 339/156 R |
| 4,611,875 | 9/1986 | Clarke et al. | 339/154 A |
| 4,648,682 | 3/1987 | Tubbs | 339/154 A |

FOREIGN PATENT DOCUMENTS

| | | | |
|---|---|---|---|
| 8303717 | 10/1983 | PCT Int'l Appl. | 439/76 |

OTHER PUBLICATIONS

AMP Incorporated, Modular Interconnection System Pamphlet, pp. 734, 735.

*Primary Examiner*—P. Austin Bradley

*Attorney, Agent, or Firm*—Anthony G. Eggink; Joel D. Skinner

[57] ABSTRACT

The present invention provides a unitary, compact telecommunication interface adapter system. The adapter system comprises a plurality of electrical contacts, a modular connector, a housing structure connected to the modular connector and an electrical interface between the modular connector and the electrical contacts. The housing structure has at least one plug end enclosing the contacts which is connectable to a 66 block telecommunications interface. The modular connector and the electrical interface are disposed within the housing structure so that the modular connector is exposed for mating via an aperture in the housing structure. The electrical interface comprises a printed circuit board having the electrical contacts extended horizontally beyond the perimeter of the printed circuit board through channels in the plug end to expose the electrical contacts for efficient and reliable mating within the channels.

15 Claims, 6 Drawing Sheets

66 BLOCK ADAPTER

BACKGROUND OF THE INVENTION

This invention relates to electrical connector apparatus and more particularly electrical adapter devices used in the telephone industry. The devices of this invention are particularly useful for electrically connecting a telephone industry 66-type block to a modular plug.

In accordance with present telecommunication industry practices, a telephone network is divided into a telephone company side and a telephone customer side. The division between the two sides of the network is referred to as the demarcation point. It is there that the responsibility for installation and maintenance of telephone company and customer equipment is divided. The demarcation point typically comprises a multiple wire, plug-type terminal or interface. Two examples of such an interface are the 66M and 66B blocks.

A 66 block is a type of electrical terminal device used in the telephone industry. This terminal device is typically installed at the demarcation point of a building by the telephone provider. The adapter of this invention permits a user to access or connect modular connector telephone equipment to a 66-type block, whether of the 66M or 66B configuration.

The 66 block is connected to and terminates the telephone company's line or lines in or at the customer's premises. This typically occurs at either the entrance cable leading into the premises or at the end of a riser cable extending to an upper floor from the entrance cable in the case of a multiple story building. The 66 block provides quick and easy connections for customer supplied single line or multiple line network equipment depending upon the customer's particular needs or requirements.

The typical 66-type block or interface has a plurality of elongated electrical contacts arranged side-by-side in horizontal rows of four (4) or six (6) and vertical columns of fifty (50). The spacing among contacts in the vertical columns of the 66 B-type block is slightly greater than that of the 66 M-Type block. The electrical contacts are typically comprised of a pair of split, scissor-like prongs that are expansible to receive the terminals of premises interconnect wiring. The contacts are contained in a nonconductive housing and exposed at their ends for hook-up or contact with the premises interconnect wiring and with an adapter or the terminals of other telecommunications equipment. The exposed contact ends have a generally rectangular configuration with horizontally oriented portions or bodies.

Telephone networks, under current industry practice have extensive, complex and variable interface and interconnect wiring installations. These complex installations make cable identification and trouble isolation a difficult and time consuming task for repair and installation technicians. Thus, there is a need for an apparatus which simplifies the connection of test or other telephone equipment. This need is further due to the development of equipment utilizing modular connectors comprising male-type plugs and female-type jacks. In the past, connector devices have been used or proposed to adapt demarcation point and other connections with modular plugs or jacks. However, these devices have generally been complex, expensive, unreliable, bulky, and difficult to use, and have been unsuited for use with 66-type blocks.

The 66 Block Adapter of the present invention provides an adapter which overcomes the shortcomings, problems and disadvantages of the prior art devices. The invention provides a compact, durable, and reliable adapter which is simple and easy to use. The 66 Block Adapter is usable on temporary or permanent telephone installations. The device is usable to provide connections to both 66M and 66B type blocks, and to either 1, 2, 3 or 4 pair modular plugs. It is usable for troubleshooting and installation purposes, and provides a means of establishing temporary cross connects, half-taps for cut over purposes, and for conversions to modular patch panels.

SUMMARY OF THE INVENTION

The device of the present invention provides a unitary, compact telecommunications interface adapter system. The universal 66 Block Adapter system comprises a modular connection means, such as a modular jack, and a housing structure connected to the modular connection means. The housing structure has a central cavity and one or more plug ends extended from the central cavity for connection to a 66-type block telecommunications interface. The adapter further has a plurality of electrical contact blades and means to electrically connect the modular connection means and the contact blades. The modular connection means and electrical connection means are disposed within the central cavity of the housing structure; the modular connection means is exposed for mating via an aperture.

Preferably, the housing structure is a bifurcated or two-part structure having a top portion and a bottom portion which are constructed of nonconductive fiberglas reinforced plastic. The top and bottom portions are coupled via a sonic fusion process. The electrical connection means is preferably a printed circuit board communicatively connected to the modular connection means and the contact blades. The contact blades are preferably angled blades which extend horizontally beyond the perimeter of the printed circuit board and are enclosed in channel means within the plug end of the housing structure.

These and other benefits of this invention will become clear from the following description by reference to the drawings.

DESCRIPTION OF THE PREFERRED EMBODIMENT

The 66 Block Adapter device of the present invention is used to adapt both 66M and 66B terminals, used in the telecommunications industry, to modular jacks. The device is used to troubleshoot a 66 block, to establish temporary cross connections and to convert a 66 block to a modular patch panel. The adapter device may be used in permanent or temporary installations and is reusable. The adapter device is compact so that multiple adapters may be used simultaneously on a single 66 block.

Figure 1:
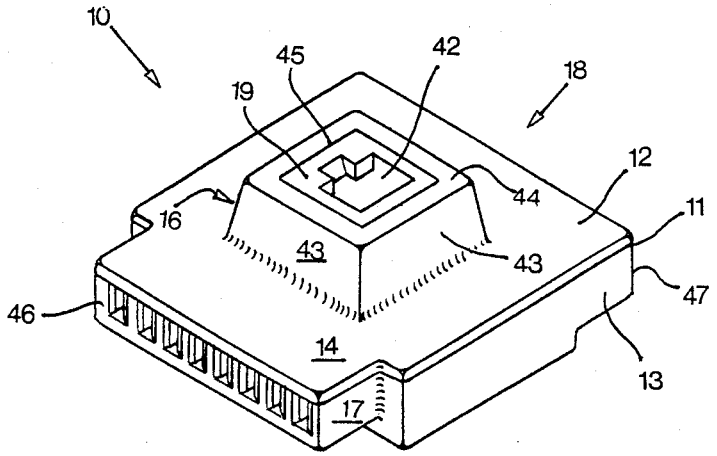
FIG. 1 is a perspective view of the 66 Block Adapter of the present invention.
Figure 2:
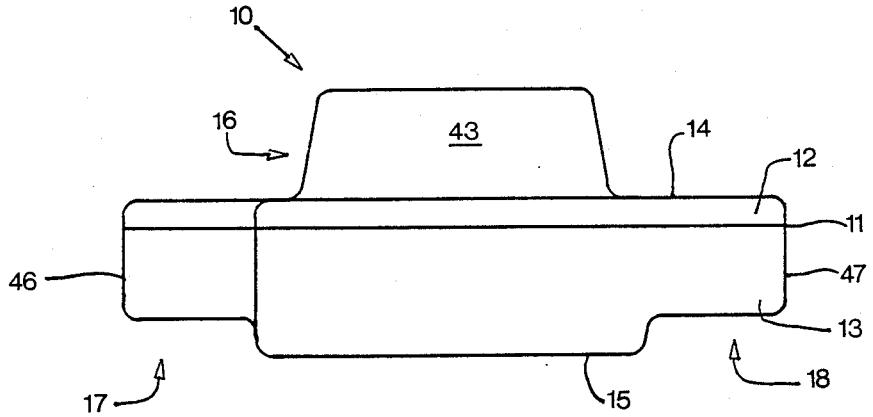
FIG. 2 is a side view of the 66 Block Adapter shown in FIG. 1.

Referring to FIGS. 1 and 2, the unitary adapter device 10 has a compact housing or case 11 and an internal modular jack assembly 19 having a female-type jack 42. The housing 11 is shown to have an upper body member 12 and a mating lower body member 13. The upper and lower body members or portions 12 and 13 are preferably of a molded, fiberglas reinforced ABS plastic construction and are preferably joined via a sonic fusion process, or by other means known to the art. This housing structure 11 configuration and method of assembly is efficient and easy to manufacture. Other housing configurations and assembly methods are within the purview of this invention, as for example, a one-piece structure formed via a molding process.

The housing structure 11 provides a compact, thin and generally rectangular structure which is easily connected and disconnected by a technician using one hand. Substantially all edges and corners of the housing structure 11 are of a smoothed or curved configuration for increased user comfort and safety. The housing structure 11 has flat top and bottom portions or surfaces 14 and 15, a raised housing portion 16, and two rectangular, generally flat and indented plug portions 17 and 18 which are extended at opposing ends of the housing structure 11. The raised portion 16 protrudes from the flat top surface 14 of the upper body member 12. It has four substantially vertical side walls 43 which are integrally formed with the top surface 14, a rectangular lip edge or surface 44 disposed at the top of the side walls 43, and a centrally disposed aperture 45 for exposing the modular jack assembly 19 for connection. The double-ended plug portions or extensions 17 and 18 have receptacle ends 46 and 47, of a predetermined configuration which are constructed and arranged to make repeated and reliable connections to 66-M and 66-B type blocks, respectively. The receptacle ends 46 and 47 have beveled channel openings 24 for improved connectability.

The plug extensions 17 and 18 are located at opposing ends of the housing structure 11. The plug ends 17 and 18 have vertical and horizontal dimensions to connect into the 66 block contact segments. The plug ends 17 and 18 provide a structure which complements the inserted contacts of the 66 block. In use, the planar top and bottom surfaces 14 and 15 of the adapter 10 are aligned vertically so that the plug ends 17 and 18 connect the vertically aligned columns of 66 block contacts. The jack 42 is oriented horizontally, or on its side, for connection in this configuration.

Plug end 17 is connectible to a 66 M-type telecommunications block interface. Plug end 17 is indented or recessed slightly inwardly with respect to each opposing side wall 13 of the housing structure 11, and slightly upwardly with respect to the bottom surface 15 of the housing structure 11. The top surface or edge of plug end 17 is shown to be substantially co-planar with the top surface 14 of the housing structure 11. The resultant vertical dimension of the plug end 17 provides clearance for the insertion of a plurality of upright contact blades 20 which will be further discussed below, and the horizontal dimension provides space for the side-by-side configuration of preferably eight (8) such contact blades 20.

Plug end 18 is shown oppositely aligned on the housing structure 11 to plug end 17, and is connectible to a 66 B-type telecommunications block interface. Plug end 18 is also recessed slightly upwardly with respect to the bottom surface 15 of the housing structure 11. The top and side surfaces of the plug end 18 are shown to be substantially co-planar with the respective top 14 and side 13 surfaces of the housing structure 11. The resultant vertical dimension of the plug end 18 is generally equivalent to that of plug end 17 to enclose the contact blades 20. However, the horizontal dimension of the plug end 18 is slightly greater than that of the plug end 17 for the side-by-side configuration of preferably eight (8) contact blades 20 to correspond to the electrical contact spacing of the 66 B-type block. The spacing of contacts in the vertical columns of the 66B-type block is greater than that of the 66 M-type block.

Figure 4:
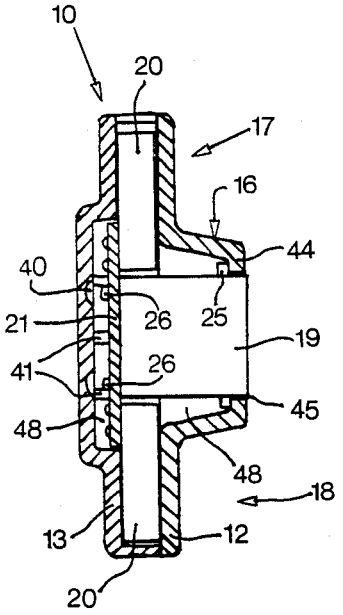
FIG. 4 is a cross-sectional view of the 66 Block Adapter shown in FIG. 3, taken along line 4—4.
Figure 3:
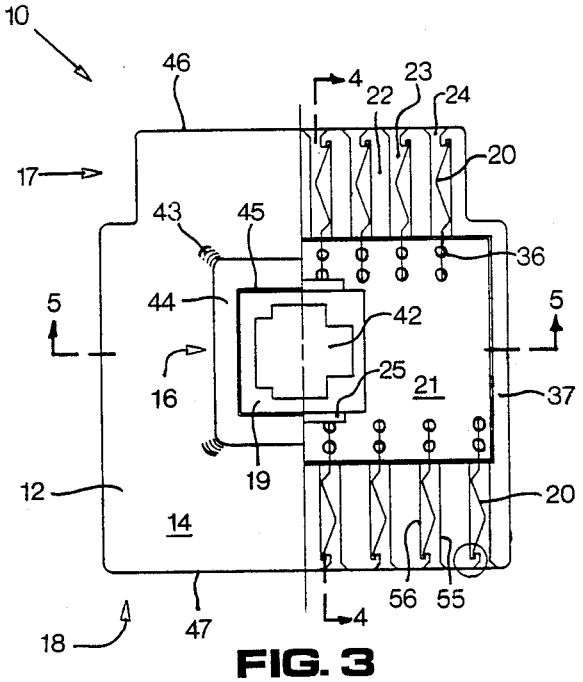
FIG. 3 is a top view of the 66 Block Adapter shown partially separated to expose its interior.
Figure 5:
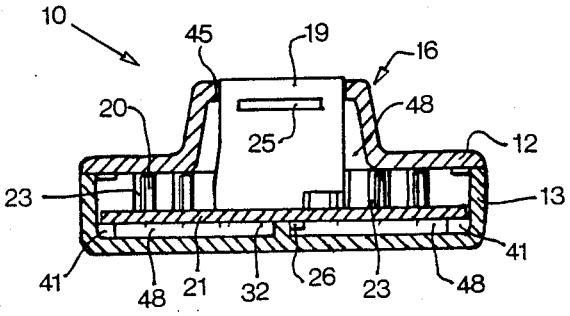
FIG. 5 is a cross-sectional view of the 66 Block Adapter shown in FIG. 3, taken along line 5—5.

FIGS. 3, 4 and 5 show the housing structure 11 having an internal cavity 48. The modular jack assembly 19 and contact blades 20 are disposed within the cavity 48 and are communicatively connected to one another via a printed circuit board (PCB) interface 21. The contact blades 20 extend from the PCB 21 horizontally through blade channels 23 of the respective plug ends 17 and 18 for electrical connection therein with the horizontally inserted contacts of the 66 block. The modular jack 19 extends upwardly from the circuit board 21 and into the raised housing portion 16 for exterior exposure via the jack aperture 45. Female jack 42 of the modular jack 19 is connectible to the modular plug of a telephone test apparatus or the like.

The printed circuit board 21 is disposed adjacent the bottom surface 15 of the housing structure 11 cavity 48. As further shown, the interior dimensions of the internal cavity 48 are substantially coextensive with the dimensions of the modular jack assembly 19 and printed circuit board 21. The contact blades 20 are connected to the printed circuit board 21 and internally exposed at the plug ends 17 and 18 for direct connection to the 66 block or terminal. The contact blades 20 are resiliently fixed in elongated channels 23 which extend from the internal cavity 48 through the opposing side plug members 17 and 18. The contact blades 20 are oriented so that they extend away from the modular jack assembly 19 in spacially opposing directions.

Figure 7:
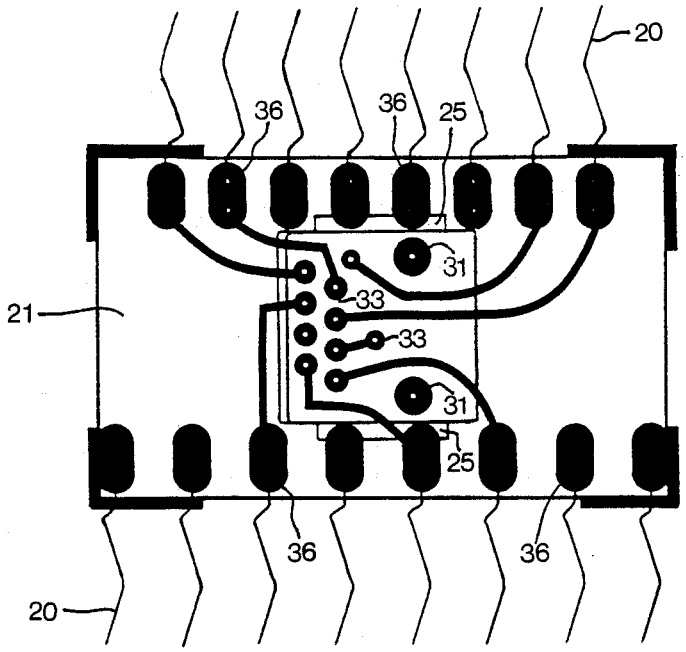
FIG. 7 is a top view of the printed circuit board of the 66 Block Adapter showing the connection of the contact blades.
Figure 8:
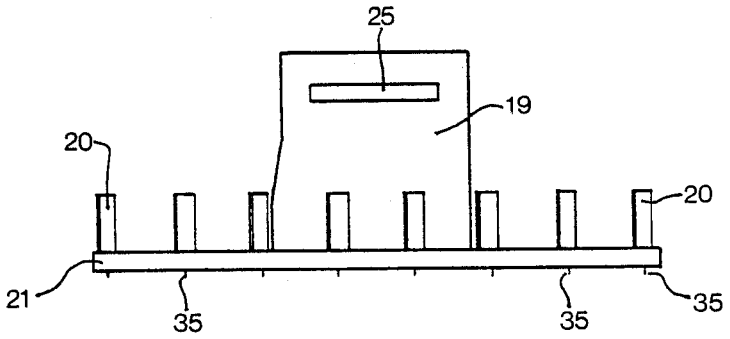
FIG. 8 is a side view of the printed circuit board of FIG. 7 and showing the modular jack mounted thereon.

FIGS. 7 and 8 show the orientation of the modular jack assembly 19 and contact blades 20 with respect to the printed circuit board 21. The modular jack assembly 19 is a standard jack as known in the art and has a flangeless housing with a panel stop 25. The modular, female-type port 42, shown in FIG. 3, is oriented perpendicular to the top surface of the PCB 21. The jack housing is preferably composed of flame retardant polyester thermoplastic and designed for direct mounting on the PCB 21. The modular jack assembly 19 preferably has eight (8) bent-wire contacts, but may have 2, 4, or 6 contacts depending upon the adapter requirement. The contacts are preferably constructed of phosphor bronze alloy plated with Gold on the contact areas, a Tin-Lead coating on the solder tails, and Nickle on the entire contact surface. An example of such a modular jack assembly is that manufactured by AMP Incorporated, Harrisburg, PA. The modular jack assembly 19 provides a simple and efficient means of connection to telecommunications equipment, data transmission equipment or related testing and repair equipment.

The modular jack assembly 19 is connected to the printed circuit board 21 via snap-in type connection posts 26 (shown in FIGS. 4 and 5) which extend from the bottom of the modular jack assembly 19 and through apertures 31 in the printed circuit board 21. Pin-type electrical solder tails 32 (see FIG. 5) also extend from the bottom of the modular jack assembly 19 and are communicatively connected to the conductive network of the printed circuit board 21 via connection apertures 33 in the PCB 21.

Figure 6:
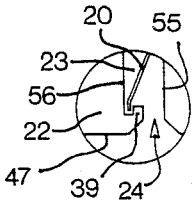
FIG. 6 is a detail view of the contact blade retaining lip shown in FIG. 3.
Figure 9:
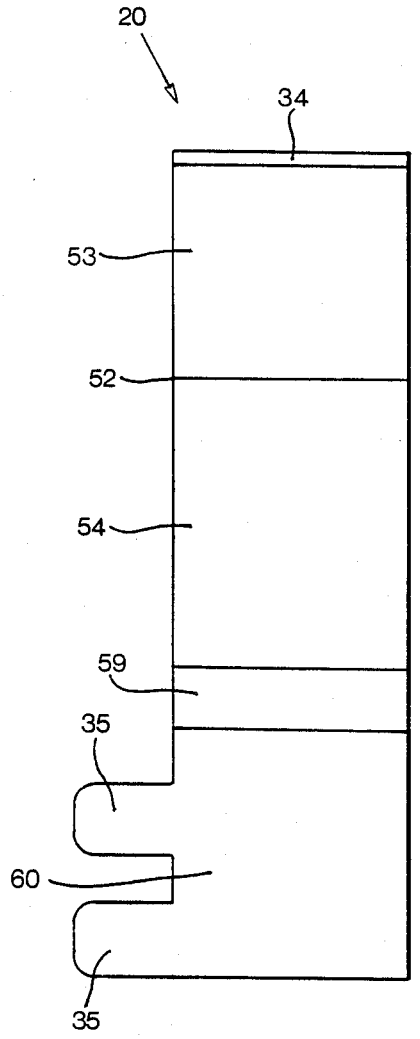
FIG. 9 is a top view of a contact blade of the 66 Block Adapter of this invention.
Figure 10:
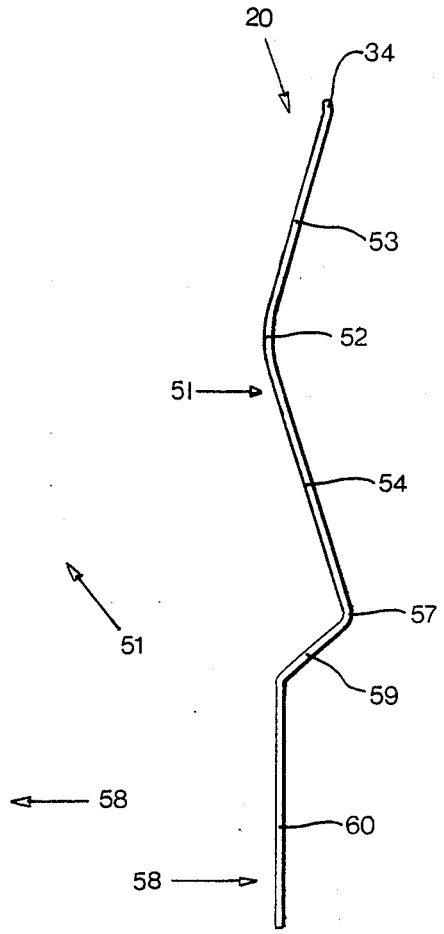
FIG. 10 is a side view of the contact blade shown in FIG. 9.
Figure 11:
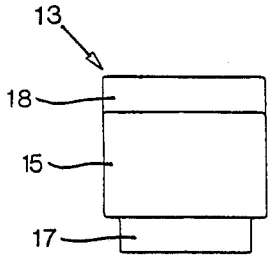
FIG. 11 is a top view of the exterior of the housing structure bottom portion of the 66 Block Adapter.
Figure 13:
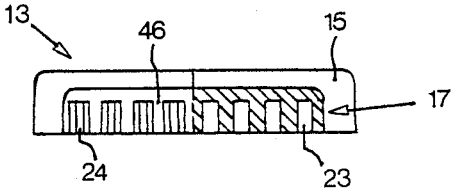
FIG. 13 is a side view of the housing structure bottom portion of FIG. 12 and shown partially in cross section along line 13.
Figure 15:
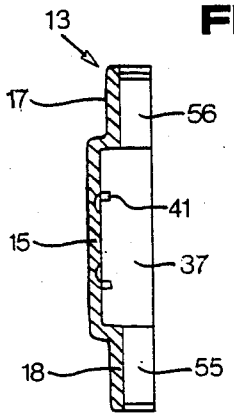
FIG. 15 is a cross-sectional view of the housing structure bottom portion shown in FIG. 12, taken along line 15—15.
Figure 12:
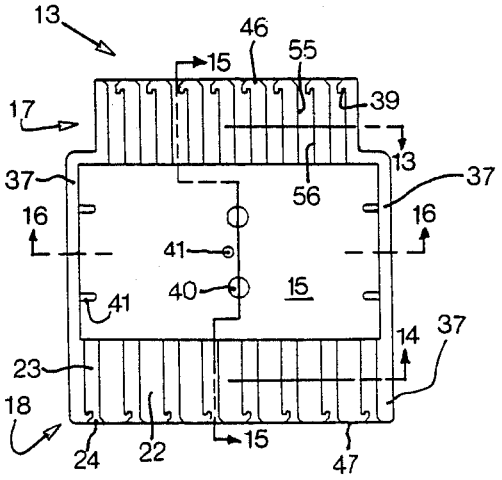
FIG. 12 is a view of the interior side of the housing structure bottom portion.
Figure 16:
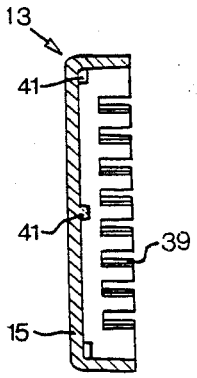
FIG. 16 is a cross-sectional view of the housing structure bottom portion shown in FIG. 12, taken along line 16—16.
Figure 14:
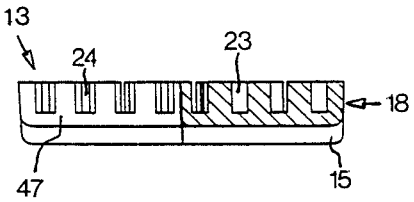
FIG. 14 is a side view of the housing structure bottom portion of FIG. 12 and also shown partially in cross section along line 13.
Figure 20:
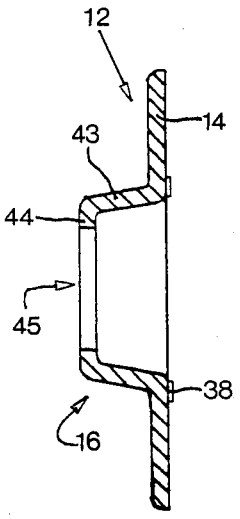
FIG. 20 is a cross-sectional view of the housing structure top portion shown in FIG. 18, taken along line 20—20.
Figure 18:
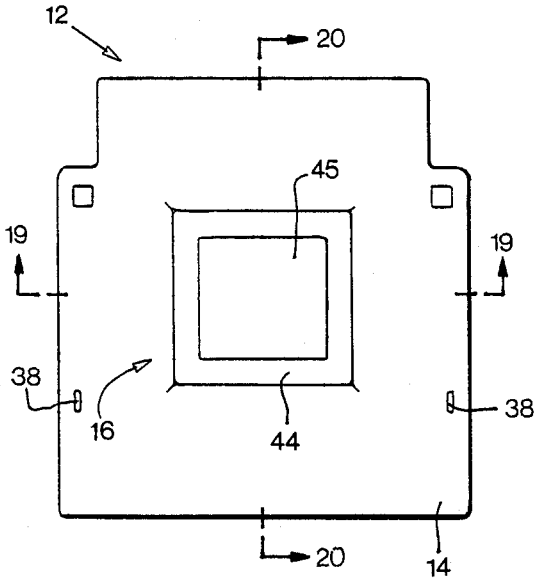
FIG. 18 is a view of the interior side of the housing structure top portion of the 66 Block Adapter.
Figure 17:
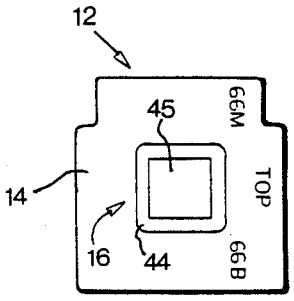
FIG. 17 is a top view of the exterior side of the housing structure top portion of the 66 Block Adapter of this invention.
Figure 19:
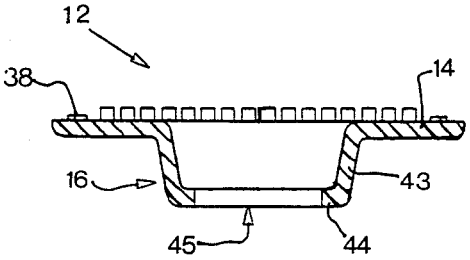
FIG. 19 is a cross-sectional view of the housing structure top portion shown in FIG. 18, taken along line 19—19.

Referring also to FIGS. 9 and 10, each contact blade 20 has a generally rectilinear shape, and preferably having a predetermined angled configuration for the resilient placement in channels 23. The angled contact blade 20 configuration preferably consists of a V-shaped body portion 51 having an axial length substantially coextensive with that of the channel 23 and including an apex region 52, a first arm member 53, and a second arm member 54. When placed in the channel 23, the apex 52 contacts or is disposed adjacent a first wall 55. The first arm member 53 extends from the apex region 52 and terminates at a blade tip 34 which is disposed adjacent a second wall 56 of the channel aperture 23, proximate the channel opening 24 and opposite the first wall 55. As shown in FIG. 6, the blade tip 34 is retained in position by a channel lip 39. A second arm member 54 extends from the apex region 52 and has an end region 57 which is also disposed adjacent the second wall 56 of the channel aperture 23. The contact blades 20 further comprise a base portion 58 integrally connected to the end region 57 of the V-shaped body portion 51 to resiliently maintain the V-shaped configuration within the channel 23. The base portion 58 has an angled arm segment 59 and an axial segment 60. The axial segment 60 is communicatively connected to the printed circuit board 21. Further, each blade 20 preferably has two blade posts 35 extending from the axial segment 60 and which outwardly extend from the plane of the blade body. Importantly, the contact blade 20 is deflectable and has an angled configuration wherein a portion of its body structure, namely, the apex region 52, resiliently maintains a trans-channel configuration so that an inserted 66 block electrical contact will intersect and contact with the surface of the contact blade 20 to thereby maintain a resilient and constant communicative electrical connection. Upon removal of the 66 block electrical contact, the contact blade 20 structure resiliently returns to its original configuration. Other embodiments, such as U-bend or half-moon shaped body structures, for example, could provide workable substitutes for the V-shaped segment 51. The preferred configuration of the V-shaped segment 51 shown provides a blade structure which is durable and resilient for repeated and reliable use, and is self-cleaning. Further, the apex region 52 of the V-shaped configuration 51 provides improved electrical contact performance by balancing the desired result of maximum contact area and blade shape retention.

The V-shaped contact blade 20 configuration of the preferred embodiment, particularly the axial or longitudinal lengths of its body portions and the horizontal displacement distances between these portions are important. For example, in one such embodiment the displacement distance between the top side of the axial segment 60 and the bottom side of the apex segment 52 is preferably about 0.025 inches, and the displacement between the top side of axial segment 60 and the end region 57 is preferably about 0.050 inches. Also, the displacement distance between the top side of the blade tip 34 and the top side of the axial segment 60 is preferably about 0.045 inches. These displacement distances provide optimum tensive forces for the blade 20 in its operative use to yield high quality and repeatable electrical connections. The bend radius of the apex 52, which defines the angle of the overall V-shaped segment 51, is preferably about 0.10 inches in radius to yield a generally rounded surface of maximum contact area. The bend radius of the end region 57 is preferably of about a 0.03 inch radius to provide proper spring tension for the V-shaped member 51. This configuration also provides for the cleaning of the 66 block terminal contacts during insertion.

The contact blades 20 are preferably constructed of an approximately 0.01 inch (0.25 mm) thick half-hardened Phosphor bronze alloy or of a Berylium Copper alloy plated with Nickle, bright Tin, or Nickle/Gold compositions. After the blades 20 are formed in the previously described configuration, they are heat-treated to full hardness. This two-step process maintains the spring tension of the blade 20 configuration and prevents flattening of the apex areas 52 and 57 during extended use. Further, such compositions yield desirable and repeatable self-cleaning electrical connection with minimum resistance for low voltage telecommunications applications.

FIGS. 7 and 8 show eight (8) contact blades 20 extending from and disposed along the opposing sides of the rectangular printed circuit board 21. The blades 20 are mounted at contact points 36 of the PCB 21. Each contact point 36 comprises a pair of apertures in the PCB 21 which receive the blade posts 35 and are preferably secured via solder. The contact points 36 are further communicatively connected to the connection apertures 33 via the conductive network of the PCB 21. The contact blades 20 extend from the outer edges of the printed circuit board 21 in a spacially parallel configuration and being uniformly spaced at a predetermined distance to correspond with the spacing of the 66 block electrical contacts. Further, the contact blades 20 are aligned perpendicular to the plane of the surface of the printed circuit board 21 and preferably lie on edge and having a height of approximately 0.17 inches (4.31 mm). This configuration provides vertically aligned contacts 20 which are well suited for use with 66 blocks.

FIGS. 11 through 16 show the bottom or lower body member 13 of the housing structure 11. The lower member 13 has a rectangular, generally flat bottom wall 15 and slightly upwardly and outwardly extending generally rectangular plug extensions 17 and 18 at its opposing ends. The top or interior surface of the lower member 13 has a pair of opposing elevated wall portions 37 which surround a shallow, open and generally flat cavity defined by wall 15. Located in the extension portions 17 and 18 are partition segments or ridges 22, the interspaces between which define the channels 23. The channels 23 have a width of preferably about 0.10 inches and a length of preferably about 0.55 inches. The partition segments 22 have vertical dimensions generally equivalent to that of the wall portions 37. Importantly, the channel lips 39, shown in detail in FIG. 6, are disposed at the entry ends or openings 24 of each channel 23. They function to hold the contact tips 34 of the blades 20 to thereby restrict the movement of the blades 20 for smooth entry and reliable communication with the 66 block contacts.

The printed circuit board 21 is disposed within the boundaries of the wall portions 37, the partition segment 22, and adjacent the bottom wall 15. The interior bottom wall 15 has a horizontal dimension substantially coextensive with that of the printed circuit board 21 and has printed circuit board ledges 41, which are shown to be thin posts that extend outwardly from the opposing wall members 37 and raised slightly from the wall 15. A board ledge 41 is also disposed generally centrally in the central cavity, raised slightly from the wall 15. The printed circuit board 21 is supported by these printed circuit board ledges 41 so that it is raised slightly from the wall 15. The conductive network of the printed circuit board 21 is thereby elevated from contact with the cavity floor 15. A pair of post reception notches 40 are also generally centrally disposed in the bottom wall 15 to receive the connection posts 26 of the jack assembly 19.

As previously discussed, the upper and lower members 12 and 13 are connected to provide an internal cavity 48 for housing the remaining adapter 10 components. The configuration of the upper member 12 covers and encloses the modular jack assembly 19 and the contact blades 20. Referring to FIGS. 17–20, the upper member 12 is comprised of the flat top surface 14 and the raised portion 16. The bottom surface of the upper member 12 has raised alignment posts 38 to engage the lower member 13 in their merged positions. One side of the top surface 14 exterior is preferably etched or imprinted with a passive polarization designation such as "TOP" to allow the user to quickly identify the proper alignment and polarity of the device for attachment to the 66 block. "66M" and "66B" designations are preferably placed on or near the respective plug ends 17 and 18 for additional ease of identification.

The merged upper and lower members 12 and 13 provide a unitary housing structure 11 for containing and aligning the modular jack assembly 19, the PCB 21 and the contact blades 20. In their connected positions, the various elements of the upper and lower members 12 and 13 cooperate to provide a compact, unitary housing structure 11 which is connectible to a 66 block telecommunications interface and to test or repair systems. The structures of the plug ends 17 and 18 of the adapter device 10 are designed to provide a stable and reliable electrical connection to a 66 block which is easy and quick to initiate or terminate and which, importantly, utilize internally positioned contact blades 20.

In summary, the adapter device 10 of this invention is connected directly to a 66M or B block by receiving the electrical contacts of the 66 block into the receptacles of the plug ends 17 or 18. Modular connections can then be made via the jack port 42. The modular connections of the 66 Block Adapter 10, therefore, allows a user to conveniently install or repair telephone equipment from 66B or 66M blocks. The adapter device 10 can also be used to test new cable installations and to isolate problems in an existing telephone service. The adapter device 10 additionally allows a user to modularly connect a 66 block to KEY and PBX common equipment or to connect directly to a telephone set with a four pair base cord. It also allows conversion of the 66 block to a patch panel to thereby allow a user to change cross connections.

As many changes are possible to the embodiments of this invention, utilizing the teachings thereof, the descriptions above and the accompanying drawings should be interpreted in the illustrative and not the limited sense.

That which is claimed is:

1. An adapter system for use with a 66-type block telecommunications interface comprising:

a. modular connection means;

b. a housing structure with a central cavity enclosing said modular connection means and having an aperture to expose said modular connection means, at least one plug end for connection to the telecommunications interface, said plug end having elongated, separated and uniformly spaced apertures extending horizontally from said central cavity and terminating in flaired openings each plug end aperture having first and second lateral walls;

c. a plurality of contact blades extending from said central cavity and being vertically aligned through said plug end apertures, said blades further being exposed for mating with the telecommunications interface at said plug end; and d. means to electrically connect said modular connection means and said blades, said electrical connection means being located in said housing structure central cavity.

2. The telecommunications interface adapted system of claim 1, wherein said modular connection means is a modular jack assembly.

3. The telecommunications adapted system of claim 1, further comprising a second plug end of a predetermined configuration.

4. The telecommunications interface adapter system of claim 1, wherein said plug end is generally rectangular, planar, and extends outwardly from said internal cavity.

5. The telecommunications interface adapter system of claim 1, wherein said plug end apertures have means to engage said contact blades, said means to engage being disposed adjacent said flaired openings of said plug end apertures.

6. The telecommunications interface adapter system of claim 1, wherein said electrical connection means comprises a printed circuit board having a conductive network connecting said contact blades.

7. The telecommunications interface adapter system of claim 1, wherein said housing structure has means for supporting said electrical connection means in said central cavity.

8. The telecommunications interface adapter system of claim 1, wherein said contact blades have a predetermined angled configuration.

9. The telecommunications interface adapter system of claim 8, wherein each said contact blade comprises a V-shaped member having a predetermined orientation in said plug end aperture and including an apex region adjacent said first wall of said plug end aperture, a first arm member extending from said apex region and terminating at a first end adjacent said second wall of said plug end aperture, and a second arm member extending from said apex region and having a second end region adjacent said second wall of said plug end aperture, said contact blades further comprising means, connected to said second end region, to resiliently maintain said V-shaped member in said predetermined configuration, said means further being communicatively connected to a printed circuit board.

10. The telecommunications interface adapted system of claim 8, wherein said contact blades are constructed of a half-hardened Phosphor bronze alloy and being coated with a substance selected from the group consisting of nickle, nickle/gold, and bright tin compositions, said contact blades being fully hardened subsequent to formation in said predetermined angled configuration.

11. The telecommunications interface adapter system of claim 8, wherein said modular connection means has a connection port arranged spacially perpendicular to a printed circuit board.

12. The telecommunications interface adapter system of claim 1, wherein said housing structure is a bifurcated structure having a top portion and a bottom portion, said top portion having passive polarization and alignment means disposed on its exterior surface.

13. The telecommunications interface adapter system of claim 12, wherein said housing structure is constructed of nonconductive fiberglas reinforced plastic, said top and bottom portions being coupled via a sonic fusion process.

14. A universal telecommunications adapter for connecting a block terminal to a modular connector comprising:

a. a modular electrical connector having bent wire leads terminating in connection means;

b. a printed circuit board communicatively connected to said modular connector at said connection means;

c. a plurality of contact blades mounted to said printer circuit board and being communicatively connected to said modular connector; and d. a housing structure having a central cavity enclosing said printed circuit board and said modular connector, a central aperture extending from said central cavity to expose said modular connector for connection, and further having at least two plug end portions, each enclosing a predetermined number of said contact blades via channel means of a predetermined configuration extending from said central cavity through said plug ends, and being for communicative connection to the block terminal.

15. A unitary and compact adapter for use in the telecommunications field for connecting a 66-type Block Interface Terminal to a modular connector comprising:

a. a modular electrical jack assembly having bent wire leads terminating in connection means;

b. a printed circuit board, said modular jack assembly being perpendicularly and communicatively connected to a top surface of said printed circuit board via said connection means;

c. a plurality of contact blades have a predetermined angular configuration and being vertically mounted to opposing sides of said printer circuit board, said contact blades extending horizontally beyond said printer circuit board and being communicatively connected to said modular jack; and d. a housing structure having a central cavity enclosing said printed circuit board and said modular jack assembly, a central aperture extending from said central cavity to expose said modular jack for external connection, and two rectilinear and generally planar plug extension structures, said plug extension structures having channel means enclosing and linearly aligning said contact blades and being connectible to the 66-type block for electrical communication.

* * * * *